US008109333B2

(12) United States Patent
Yee

(10) Patent No.: US 8,109,333 B2
(45) Date of Patent: Feb. 7, 2012

(54) INDICATOR AND METHOD

(75) Inventor: Chee Kong Yee, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 272 days.

(21) Appl. No.: 12/437,305

(22) Filed: May 7, 2009

(65) Prior Publication Data

US 2010/0282461 A1 Nov. 11, 2010

(51) Int. Cl.
*E21B 23/03* (2006.01)
*E21B 47/09* (2012.01)

(52) U.S. Cl. ..... 166/255.1; 166/113; 166/64

(58) Field of Classification Search ..... 166/255.1, 166/113, 64
See application file for complete search history.

(56) References Cited

U.S. PATENT DOCUMENTS

| | | | | |
|---|---|---|---|---|
| 3,101,119 | A * | 8/1963 | Dickens | 166/206 |
| 3,802,506 | A * | 4/1974 | Young | 166/136 |
| 3,902,361 | A * | 9/1975 | Watson | 73/152.57 |
| 4,398,601 | A * | 8/1983 | Schwendemann et al. | 166/217 |
| 4,840,229 | A * | 6/1989 | Proctor et al. | 166/381 |
| 2005/0051337 | A1 * | 3/2005 | Jennings et al. | 166/348 |

OTHER PUBLICATIONS

"linEXX System Achieves World's First Commercial Monobore Expandable Liner Extension," [online]; [retrieved Jun. 7, 2010]; retrieved from the Internet http://www.bakerhughesdirect.com/cgi/bhi/resources/ExternalFileHandler.jsp?bookmarkable=Yes &path=private/BHI/public/bakerhughes/resources/indepth/13.no1.2007_contents.html.

* cited by examiner

*Primary Examiner* — Giovanna Wright
(74) *Attorney, Agent, or Firm* — Cantor Colburn LLP

(57) ABSTRACT

An indicator comprising a band having a first radial dimension; one or more protectors having a greater radial dimension and disposed sufficiently proximate the band to substantially avoid wear of the band during running of the indicator and method.

13 Claims, 3 Drawing Sheets

INDICATOR AND METHOD

BACKGROUND

In subterranean drilling and completion arts there is commonly need to provide feedback to an operator of conditions downhole. For example, it is often helpful if not necessary to know when a string reaches a selected location for a number of reasons associated with downhole operations. One such situation is to determine when the string has reached a selected position downhole in order to begin another operation such as a liner expansion. Beginning a liner expansion too shallowly or too deep relative to the selected depth tends to produce results in the completion that are less desirable and may have to be corrected thereby costing money and time.

Snap in and snap out collets have been used in connection with such operations and while they function generally well for their intended purpose, they are less than entirely reliable as it is possible for them to indicate at a point downhole that is not the intended point.

As downhole operations become more and more precision driven and therefore precision sensitive, the art will well receive improved indicators having increased precision and confidence in operation.

SUMMARY

An indicator including a band having a first radial dimension, one or more protectors having a greater radial dimension and disposed sufficiently proximate the band to substantially avoid wear of the band during running of the indicator.

A method for indicating landing of an indicator at a selected location including running an indicator comprising a band having a first radial dimension, one or more protectors having a greater radial dimension and disposed sufficiently proximate the band to substantially avoid wear of the band during running of the indicator; observing change in weight on a string connected to the indicator.

BRIEF DESCRIPTION OF THE FIGURES

Referring now to the drawings wherein like elements are numbered alike in the Figures.

DETAILED DESCRIPTION

Figure 1:
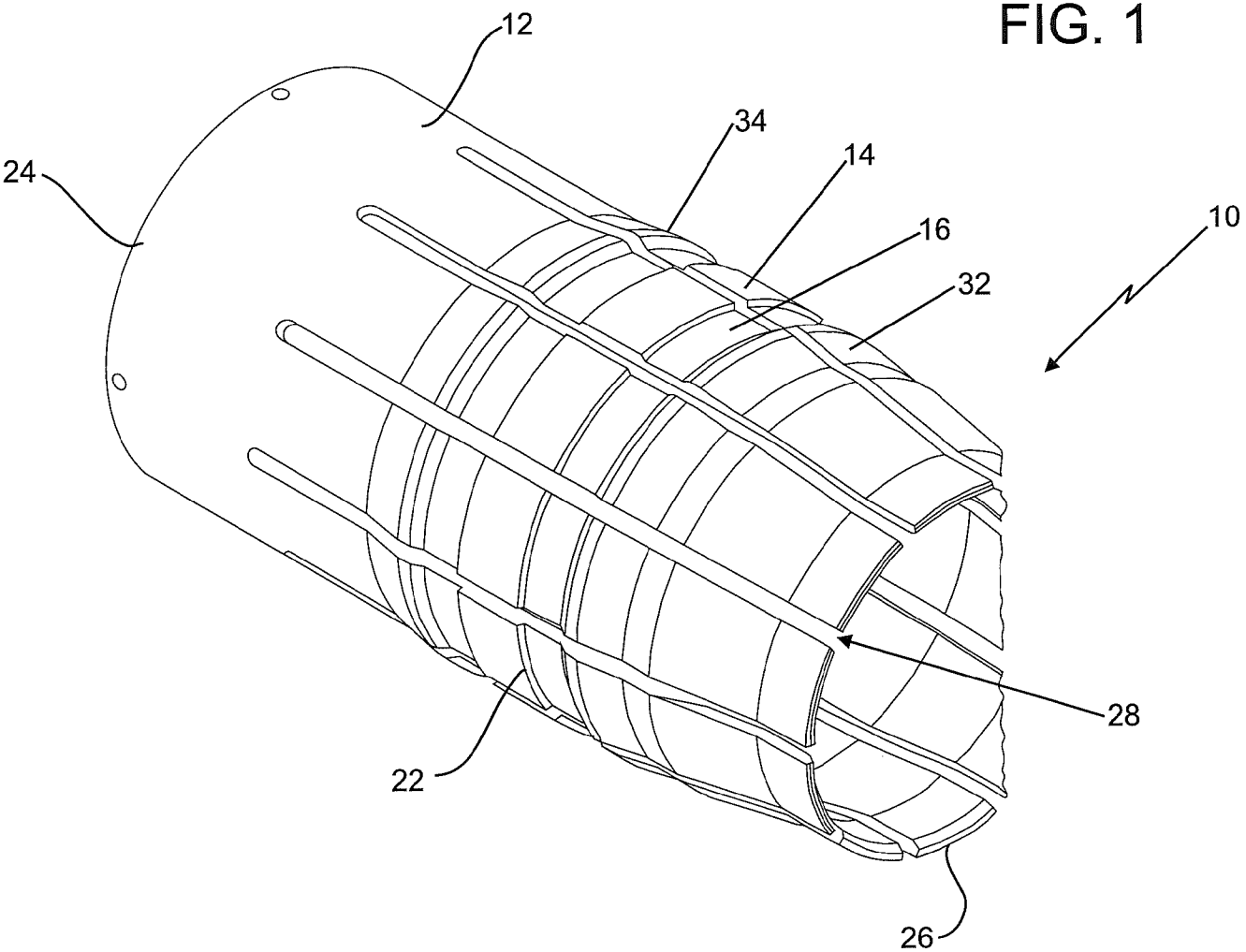
FIG. 1 is a perspective view of an indicator disclosed herein.

Referring to FIG. 1, an indicator 10 is illustrated. It is to be understood that the indicator will be run into a subterranean formation through a borehole in the formation on a "string", the term being abundantly familiar to those of ordinary skill in the subterranean drilling and completion art. The specifically illustrated embodiment of indicator is configured as a collet but it is to be understood that the features of the indicator 10 responsible for its function can be employed with alternate carrier 12 configurations and hence the invention is not limited to a collet. The indicator requires an indicator band 14 that is proud of a base surface 16 of the carrier 12. The indicator band 14 includes perimetrical edges 20 and 22 that are in one embodiment angled at about 70 degrees (in an axial direction of the tool, the angles best illustrated in the cross sectional view of FIG. 2). In other embodiments different angles might be employed within an operative range. Angles of as little as about 30 degrees will still provide positive indication of landing while angles as great as about 80 degrees are still operative significant feedback to the operator and retrievability.

Figure 2:
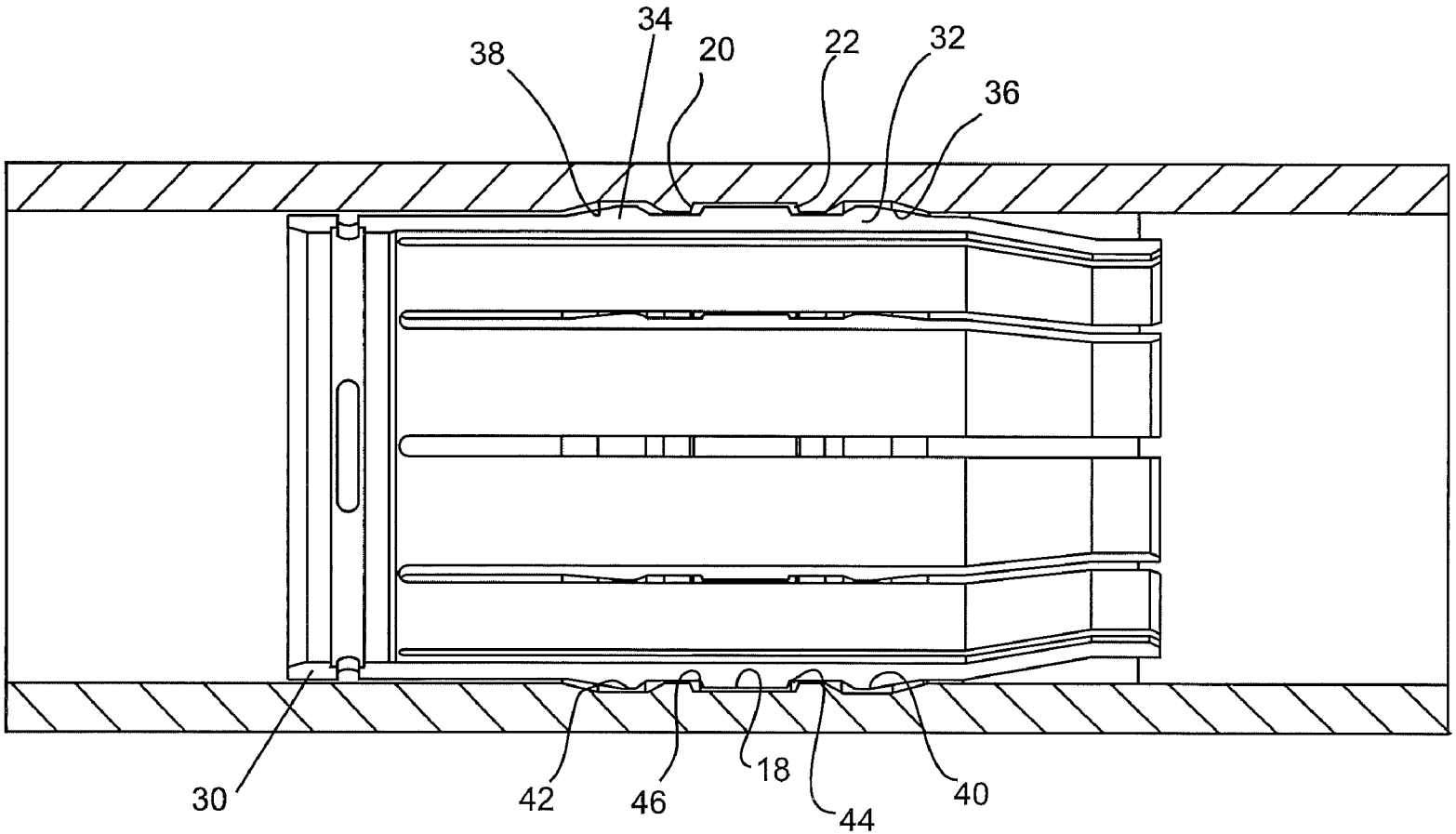
FIG. 2 is an axial cross sectional view of the indicator illustrated in FIG. 1 within a landing profile.

In the particular embodiment of the FIG. 1 illustration the carrier 12 as noted is a collet configuration where a tubular overall structure is perimetrically complete at one end 24 and perimetrically incomplete at an opposing end 26. The incomplete end 26 may be configured with one or more kerfs 28 therein to provide the carrier 12 with flexibility in the radial direction. As illustrated in FIG. 2, the radial flexibility is employed inwardly while resilience is employed outwardly to facilitate engagement of the band 14 with the profile 18.

The band 14 is receivable in a profile groove 18 (see FIG. 2) of a profile 30, which reception will provide an indication that the carrier 12 has reached its intended landing site. The indication comes to the operator in the form of weight taken off the string from surface. Weight is taken off the string because once the indicator band has engaged the profile groove 18, weight is taken up on the profile 30.

On at least one axial side of the band 14 is a protector 32. In the illustrated embodiment there is also a protector 34. It is to be understood that either or both may be used in particular embodiments. The one or more protectors that are used have for their purpose to prevent or substantially reduce contact of the band 14 with other structures with which it is not intended to come into contact. In one embodiment, the one or more protectors are about 20 thousandths of an inch larger radially than band 14, while a range of about 20 to about 60 thousandths is operable. This difference in radial dimension avoids becoming an obstruction in the downhole environment but effectively protects the band 14 from wear so that reliable engagement with groove 18 is assured. In addition to the greater radial dimension of the protector(s) 32, 34, their cross sectional shape is configured to enhance desired engagement while reducing the possibility of the indicator creating a false indication of arrival at the selected location.

Each protector 32, 34 includes a low slope surface 36, 38 respectively. The surface 36, 38 is at an angle of about 15 degrees to about 30 degrees providing that the angle is always less than that of surfaces 20 and 22. This configuration allows the protector to slide past obstructions in the downhole environment easily thereby avoiding false weight changes. Further, the surface 36, 38 will help move the string away from the obstruction further protecting the band 14 and increasing reliability of the indicator. It will be noted that in the illustrated embodiment, the surfaces 36, 38 are faced in two directions, one uphole and one downhole. This means that the benefits noted are available both during run in and pull out.

In order for the indicator 10 to function as intended, the profile 30 must be internally configured to receive the band 14 and the protector(s) 32, 34. Thereby, upon the indicator reaching the desired depth in the borehole, the band 14 and the protectors 32, 34 will automatically snap into engagement with the groove 18 and recesses 40 and 42 respectively. The edges 20 and 22 will seat on edges 44 and 46 respectively to provide the appropriate weight change and thereby indicate landing and also to hold the band 14 in engagement until a selected amount of overpull is applied to remove the indicator from the borehole.

Figure 3:
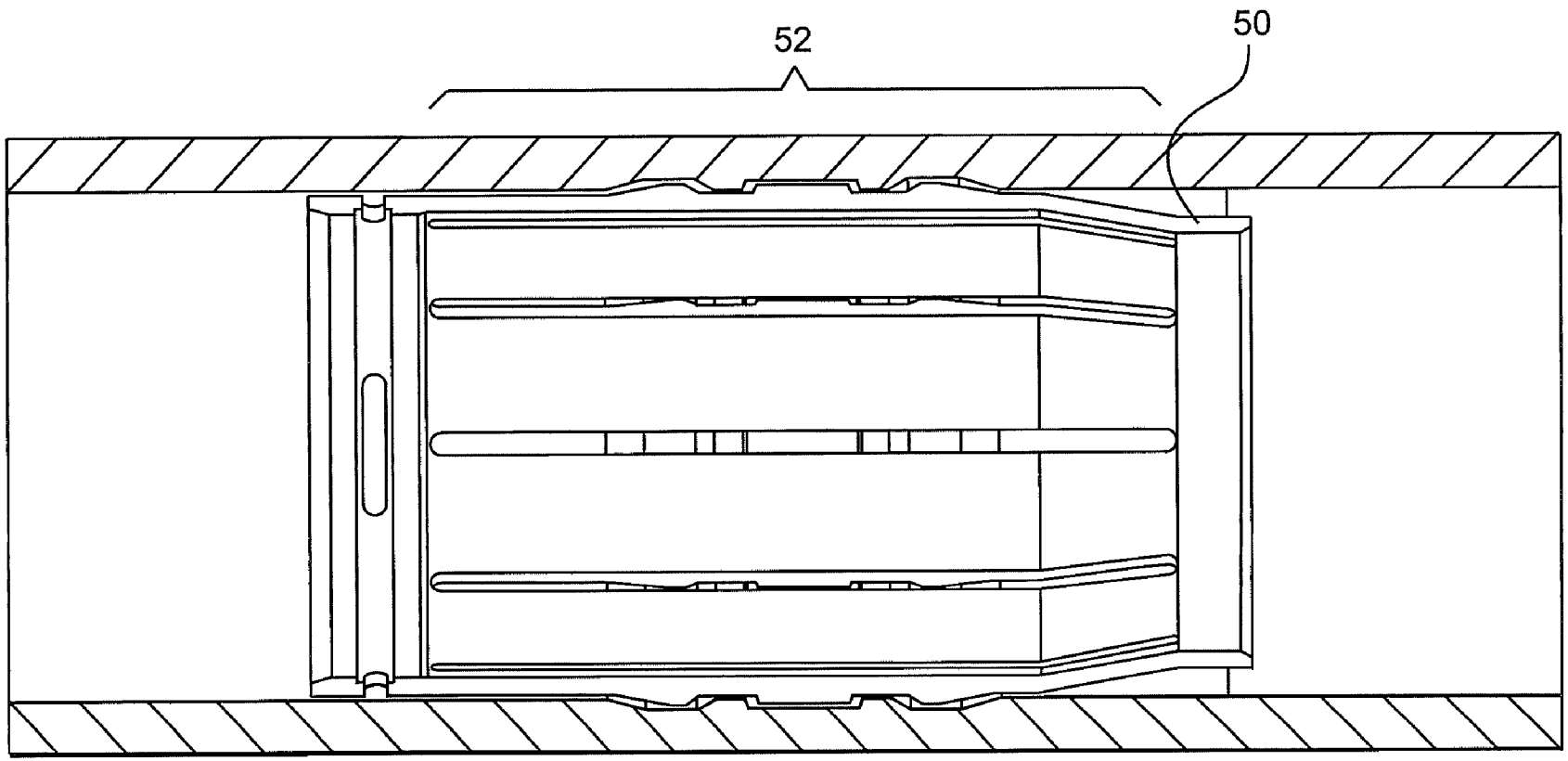
FIG. 3 is an alternate embodiment of the indicator having a closed end.

Referring to FIG. 3, the incomplete end 26 from the first described embodiment is left complete perimetrically with kerfs therefore starting axially inboard of both ends of the indicator. This is clearly shown in FIG. 3 with the now closed end 50 illustrated. The closed end 50 may simply be an uncut portion of the original tubular or may be added to the configuration of FIGS. 1 and 2, if desired, by welding or other attachment procedure. In this embodiment, a higher spring force is achieved due to the greater support for the flexible portion of the indicator identified with bracket and numeral 52 in FIG. 3.

While it has been noted above that a collet is not the only structure contemplated by the inventor it is further noted that the band and protectors could be disposed upon a radially extendible dog for example in a suitable housing with similar results. The band would still be protected from wear and a positive indication of landing would be assured.

While one or more embodiments have been shown and described, modifications and substitutions may be made thereto without departing from the spirit and scope of the invention. Accordingly, it is to be understood that the present invention has been described by way of illustrations and not limitation.

The invention claimed is:

1. An indicator comprising:

a band having a first radial dimension;

one or more protectors having a greater radial dimension when the indicator is not engaged, the one or more protectors disposed sufficiently proximate the band to substantially avoid wear of the band during running of the indicator.

2. The indicator as claimed in claim 1 wherein the band includes a pair of opposing edges each having an angle of up to about 80 degrees.

3. The indicator as claimed in claim 2 wherein the one or more protectors include a surface having an angle that is less than an angle of at least one of the edges of the band.

4. The indicator as claimed in claim 1 wherein the one or more protectors include a surface having an angle from about 15 degrees to about 30 degrees.

5. The indicator as claimed in claim 1 wherein the indicator includes a carrier.

6. The indicator as claimed in claim 5 wherein carrier is in the form of a collet.

7. The indicator as claimed in claim 5 wherein the carrier includes one or more kerfs.

8. The indicator as claimed in claim 7 wherein the one or more kerfs extend to one end of the indicator.

9. The indicator as claimed in claim 7 wherein the one or more kerfs are bounded at both ends of the indicator.

10. The indicator as claimed in claim 1 wherein the one or more protectors greater radial dimension is about 20 to about 60 thousandths of an inch.

11. The indicator as claimed in claim 1 wherein the greater radial dimension is about 20 thousandths of an inch.

12. A method for indicating landing of an indicator at a selected location comprising:

running the indicator as claimed in claim 1;

observing change in weight on a string connected to the indicator.

13. A method as claimed in claim 12, the method further comprising snapping the band into a profile;

bearing weight on the profile;

transmitting the weight borne to the string and to an operator.

* * * * *